US008677594B2

(12) United States Patent
Cook

(10) Patent No.: US 8,677,594 B2
(45) Date of Patent: Mar. 25, 2014

(54) CONTAINER SEALS

(75) Inventor: Steven T. Cook, Miamisburg, OH (US)

(73) Assignee: Dayton Systems Group, Inc., Miamisburg, OH (US)

( * ) Notice: Subject to any disclaimer, the term of this patent is extended or adjusted under 35 U.S.C. 154(b) by 954 days.

(21) Appl. No.: 11/794,588

(22) PCT Filed: Dec. 31, 2005

(86) PCT No.: PCT/US2005/047617

§ 371 (c)(1), (2), (4) Date: Jul. 2, 2008

(87) PCT Pub. No.: WO2006/072079

PCT Pub. Date: Jul. 6, 2006

(65) Prior Publication Data

US 2009/0113700 A1 May 7, 2009

Related U.S. Application Data

(60) Provisional application No. 60/640,785, filed on Dec. 31, 2004.

(51) Int. Cl.
*B21D 39/03* (2006.01)

(52) U.S. Cl.
USPC ..... 29/430; 29/773; 29/801

(58) Field of Classification Search
USPC ..... 29/416, 492, 430, 773, 783, 785, 790, 29/792, 786, 789, 793, 797, 564, 564.1, 29/564.2, 564.6, 564.7, 564.8, 33 P; 83/110; 53/287, 290, 485, 487, 490; 413/58
See application file for complete search history.

(56) References Cited

U.S. PATENT DOCUMENTS

| | | | | |
|---|---|---|---|---|
| 1,908,898 | A | | 5/1933 | Johnson |
| 2,912,042 | A | | 11/1959 | Jenkins |
| 3,546,768 | A | * | 12/1970 | Acton et al. ..... 53/52 |
| 3,959,061 | A | | 5/1976 | Renck et al. |
| 4,068,450 | A | * | 1/1978 | Easter ..... 53/331.5 |
| 4,155,439 | A | * | 5/1979 | Fletcher et al. ..... 198/339.1 |

(Continued)

FOREIGN PATENT DOCUMENTS

| | | | |
|---|---|---|---|
| EP | 0 003 400 | A1 | 8/1979 |
| EP | 0 900 742 | A1 | 3/1999 |
| WO | WO 02/49787 | A1 | 6/2002 |
| WO | WO 2004/007296 | A2 | 1/2004 |

OTHER PUBLICATIONS

Machine Translation of EP0900742 A1; Author: Weiss; Mar. 10, 1999.*

EP 05 85 6084 Search Report, mailed May 3, 2010.

*Primary Examiner* — David Bryant
*Assistant Examiner* — Ryan J Walters
(74) *Attorney, Agent, or Firm* — Fay Sharpe LLP

(57) ABSTRACT

A method, and apparatus for performing the method, is provided for the purpose of forming and inserting seal pieces into a container cap of a type which comprises an integral cup-like member having a top panel, a skirt depending from the top panel, and a plurality of cap lugs formed in the rim and extending partially inward from the rim. A supply strip of flexible seal material is directed into proximity to the inserting stations and precisely cut seal pieces from the strip are inserted into the caps.

7 Claims, 18 Drawing Sheets

(56) References Cited

U.S. PATENT DOCUMENTS 4,341,498 A 7/1982 Ellis
4,822,326 A * 4/1989 Ullman et al. ..... 493/77
6,015,062 A 1/2000 Bachmann et al.
6,082,944 A 7/2000 Bachmann et al.
2005/0138984 A1 6/2005 Cook et al.
2006/0140745 A1 * 6/2006 Buswell et al. ..... 413/8

* cited by examiner

CONTAINER SEALS

This application is a national filing under 35 U.S.C. 371 of International Application No. PCT/US2005/047617, International Filing Date 31 Dec. 2005, which claims priority from and is based upon U.S. Provisional patent application Ser. No. 60/640785, filed 31 Dec. 2004.

RELATED APPLICATION

This application is based upon U.S. Provisional patent application Ser. No. 60/640,785, filed Dec. 31, 2004, and claims priority of the filing date thereof.

BACKGROUND OF THE INVENTION

This application is related to the type of reclosable container disclosed in U.S. Pat. Nos. 6,082,944 and 6,015,062, and to the disclosure of the related published International Application Ser. No. PCT/US97/22074, entitled RESEALABLE BEVERAGE CONTAINER & TOP THEREFOR, filed 17 Nov. 1997. The invention disclosed herein is related to seals within a container cap having the general shape of an inverted cup that fits closely about and interacts with a container body having a neck. Such neck has a pour opening at its top and a plurality of thread lugs formed outwardly in the neck material, at a predetermined spacing below the pour opening. The thread lugs interact with a plurality of cap lugs extending inward from, and spaced about, the lower rim of the cap to draw the interior surface (or underside) of the cap central panel toward the pour opening to complete a seal between the neck and cap.

Previous such seal constructions for this style of container have included various types of seal materials applied to the cap underside, primarily a preformed, (or formed in situ) piece or ring, for example of polypropylene. Materials of such seals may vary with the type of content in the container, and there is a need to provide a different approach to placing seals of different compositions within the caps of such containers, as may be required to accommodate the needs of properly packaging different contents of the container. Such needs may involve pressurization or vacuum packing of the container contents, ability to withstand the high temperature and elevated pressure of retort operations after filling and closing, or possible exposure to wide ranges of temperature from other sources after filling and sealing. These are but a few potential requirements encountered in adapting such a container to a large variety of potential contents.

SUMMARY OF THE INVENTION

The present invention provides a method of and apparatus for utilizing a strip or length of suitable somewhat flexible seal material, from which a seal is precisely cut, preferably die cut. The preferred form of the seal is a piece. The diameter of such a piece is greater than the internal diameter of the cap lugs and approximately equal to the interior of the cap skirt, such that a friction fit may exist between the piece perimeter and the inner diameter of the skirt. The result is a unique cap and seal combination providing an effective closure for containers that may be filled with a variety of products, and simplification of installation of a wide variety of seal materials.

Finished caps exit from a cap forming apparatus, such as disclosed in published International Application Ser. No. PCT/U.S. 01/49,392, entitled LUGGED CAP FORMING SYSTEM filed Dec. 19, 2001 [Docket DSG 2 0014PCT], said disclosure being incorporated herein by reference. The caps are passed through a seal forming apparatus including a station (or stations) in which seal pieces of the desired dimension are separated from the material, then pushed past the cap lugs into the cap skirt.

Due to the fit of the seal within the cap skirt, the seal remains within the cap, slightly spaced from the underside of the cap. When the caps are applied onto the container necks, the rolled rim defining the pour opening of the container will press (and advance if necessary) the seal into a tight sealing fit between the cap panel underside and the pour opening rim, and (if desired) about a portion of the exterior of the pour opening rim.

The material from which the seals are formed may be a suitable single layer or multiple layer laminate, chosen according to seal compatibility and resistance requirements of the particular packaging operation. Essentially the same apparatus and method can form seals (usually pieces) from a variety of materials, allowing simple changes to accommodate a variety of seal requirements. A suitable source of such materials is Tri-Seal (a Tekni-Plex Co.) located in Blauvelt, N.Y., USA.

Different forms of such seal forming and inserting apparatus are disclosed and described in greater detail below.

DETAILED DESCRIPTION OF FIRST EMBODIMENT

Figure 1:
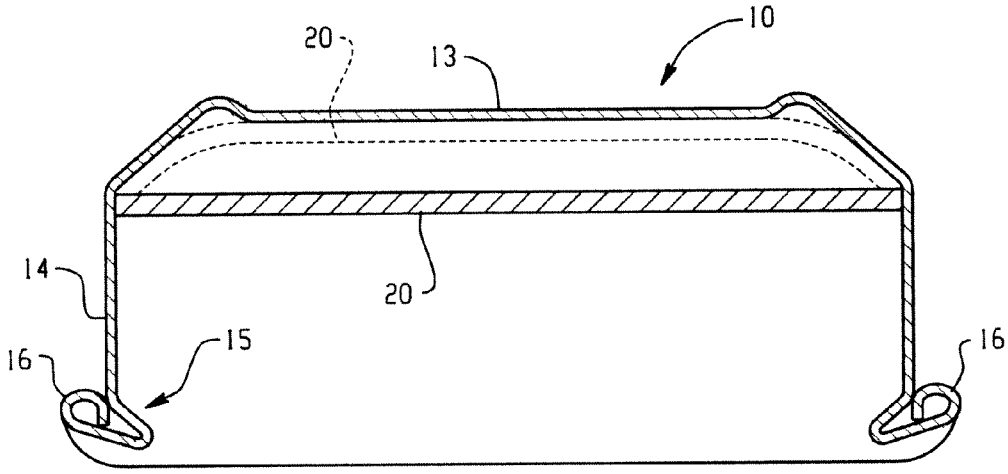
FIG. 1 is a cross-sectional view through a lugged cap of the type to which the present invention pertains, showing a seal piece placed within the cap interior.

FIGS. 1-5 of the drawings illustrate a working embodiment of the present invention including the provision of a strip or length of suitable seal material M supplied in a roll from which a seal piece 20 is precisely cut, preferably die cut. The seal material from which the seal pieces are formed may be a suitable single layer or multiple layer laminate, chosen according to seal compatibility and resistance requirements of the particular packaging operation. For example, suitable materials are commercially available (see Summary of the Invention) in relatively large rolls.

The caps 10 are available in various sizes, and are in the general form of an inverted cup 12 (FIG. 1) including a top panel 13, and a skirt 14 terminating in a rolled lower edge 15. Details of the caps are shown in the published International Application Ser. No. PCT/U.S. 01/149,392 identified above. When placed on and attached to a container, cap skirt 14 extends around the neck portion of a container spout. The exterior of the so-applied cap is referred to as the "public" side, and the interior of the cap is referred to as the "product" side.

As seen in FIG. 1, the diameter of seal piece 20 (usually disc shaped) greater than the internal diameter of the cap lugs 16 that project inward from lower edge or rim 18 of skirt 14 (see above). The diameter of piece 20 is approximately the same as the inner diameter of the skirt 14, such that a friction fit will exist between the seal piece perimeter 11 and the inner diameter of skirt 14. When the caps are applied to the necks and pour openings of containers, the seal piece conforms to the interior of the top of the cap; see dash lines in FIG. 1.

Figure 2:
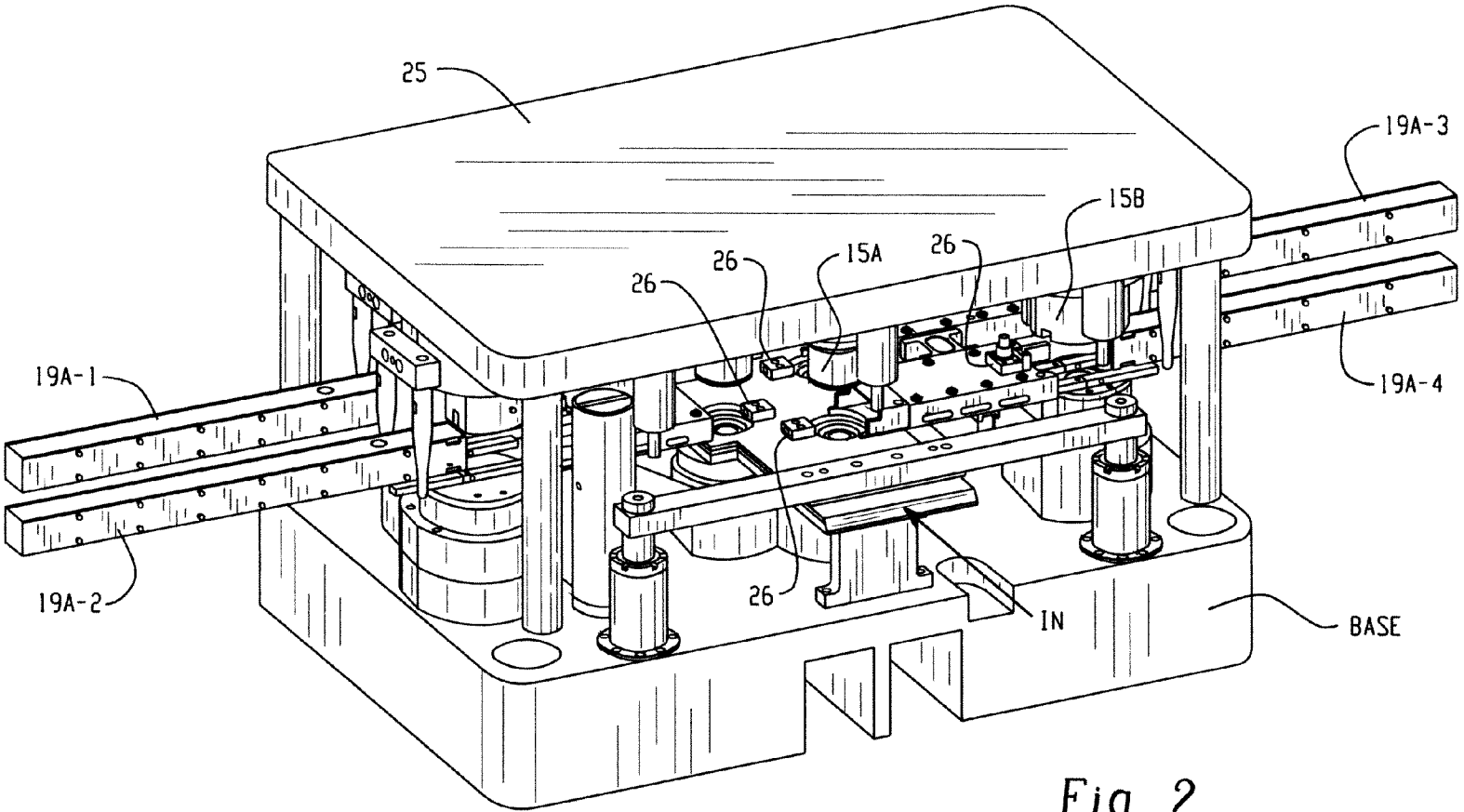
Fig. 2 PRIOR ART
FIG. 2 is a perspective view of the tooling for a lugged cap forming system from which such caps are supplied.

Formed caps 10 exit from a cap forming apparatus 25 via the exit chutes 19A-1, 19A-2, 19A-3, 19A-4, such as disclosed in said published International Application Ser. No. PCT/U.S. 01/49,392, (FIG. 2 Prior Art). The caps may be propelled (for example) by one or more air jets 26, and oriented in an upright position (skirt rim down or public side up), and are delivered successively into receptors 32 (FIGS. 3, 4, & 5).

Figure 3:
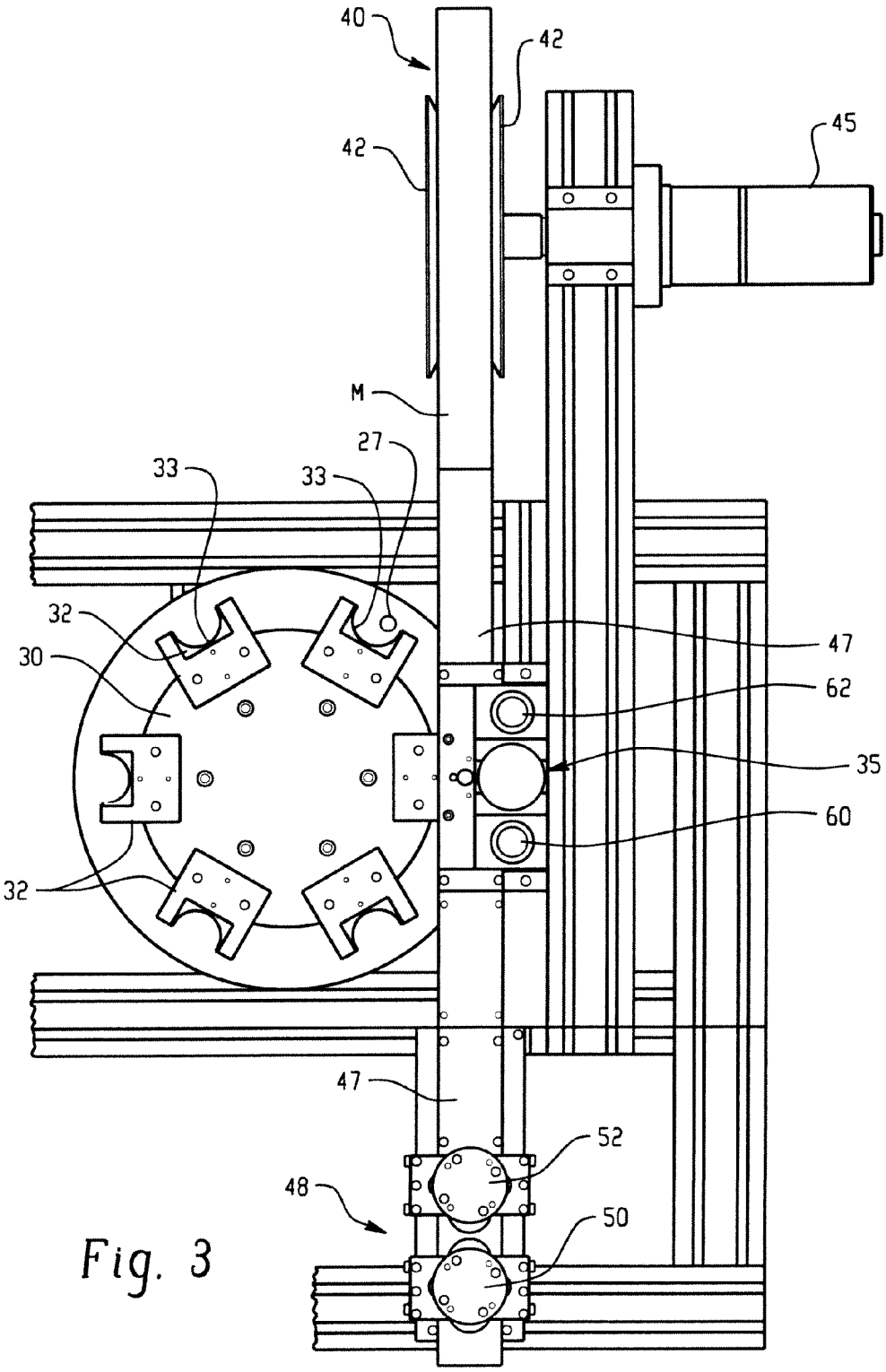
FIG. 3 is a partial plan view of one form of a seal piece forming and inserting apparatus using the novel method of the invention for positioning an inverted ((public side up) lugged cap within a seal piece cutting and inserting system.
Figure 4:
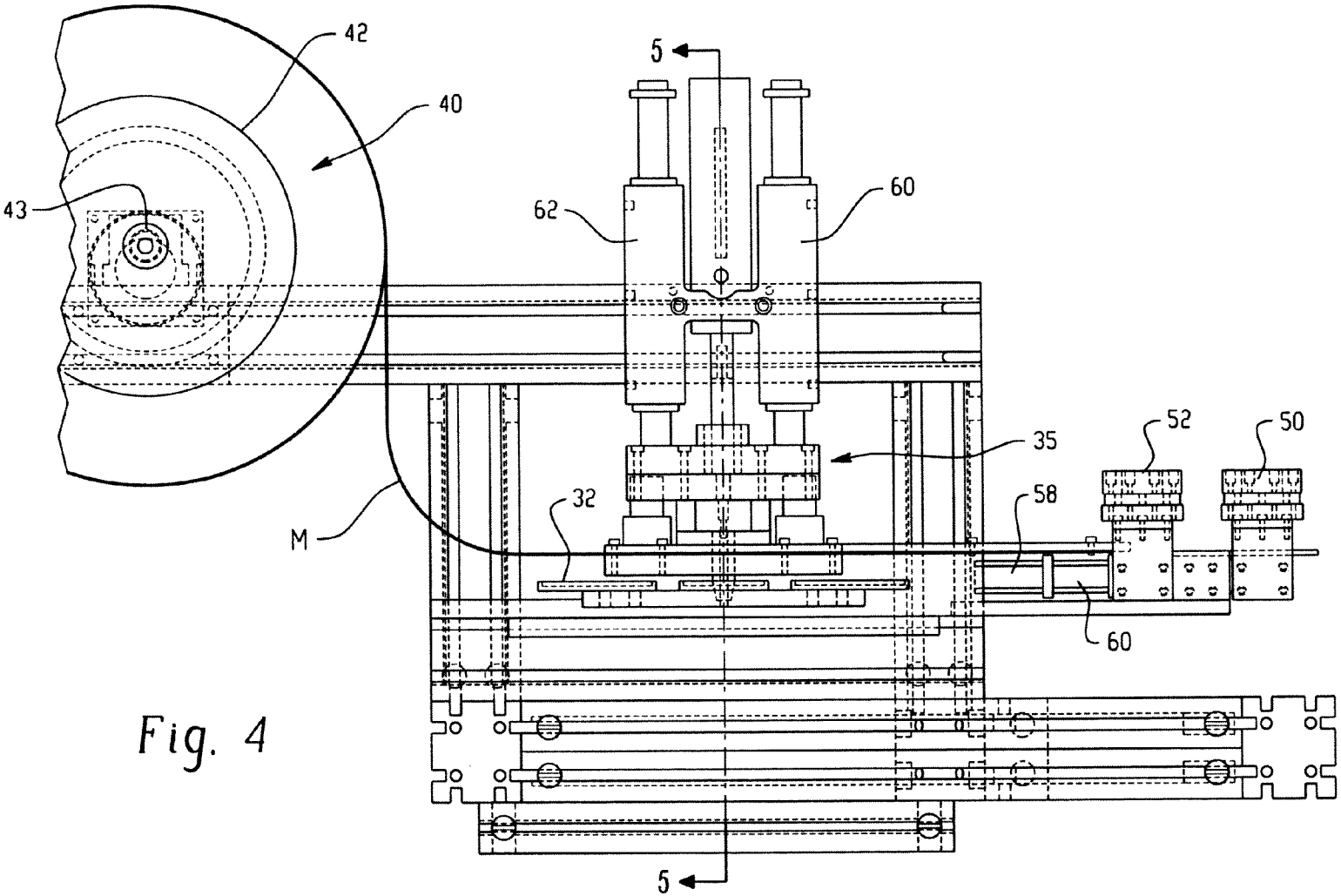
FIG. 4 is a side view of the other form of apparatus as seen from the left side of FIG. 1.
Figure 5:
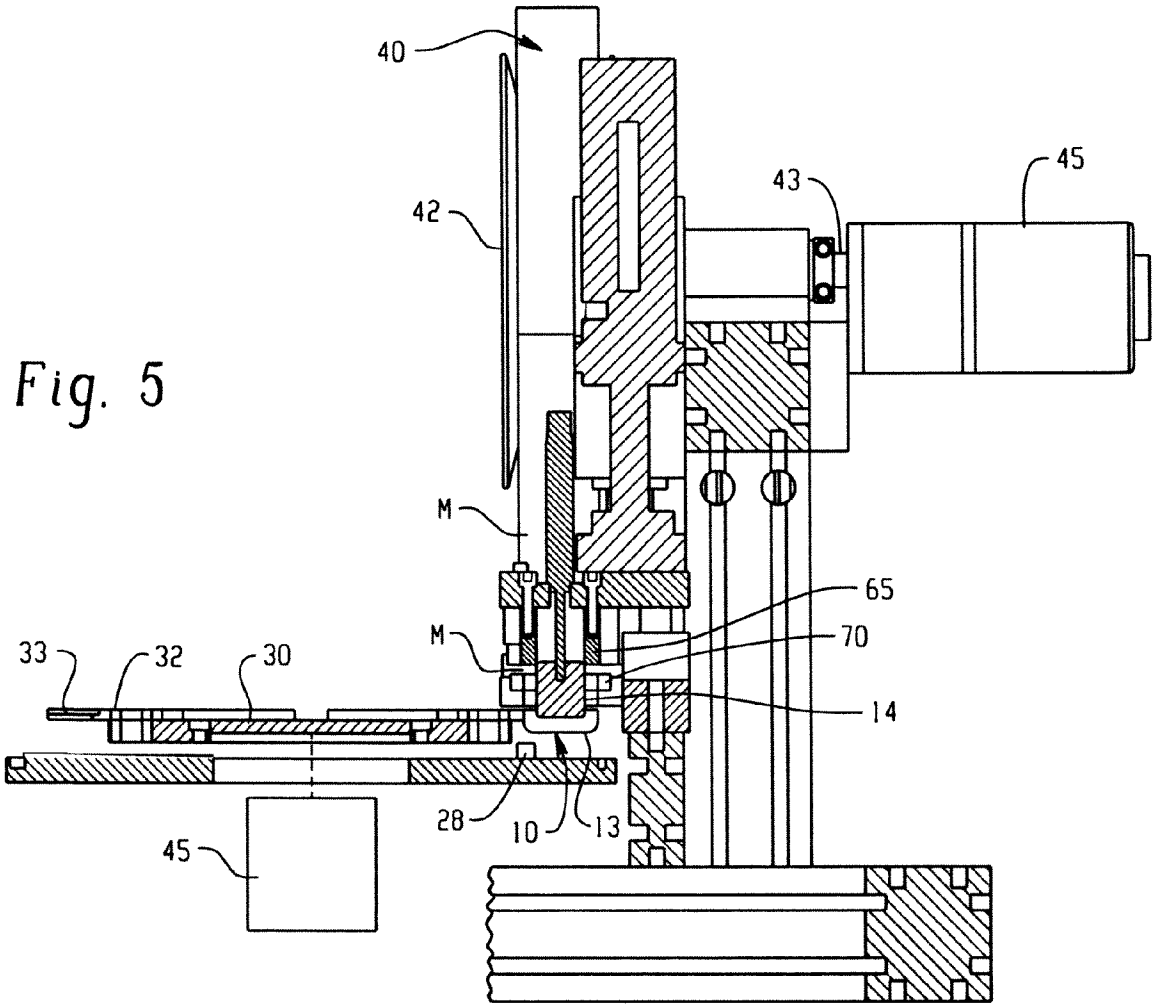
FIG. 5 is a cross-sectional view taken on line 5-5 in FIG. 4.

FIGS. 3-5, illustrate the first embodiment of seal forming and inserting apparatus. In this embodiment, the cap forming apparatus will include tooling of the type used in the cap forming apparatus shown in FIG. 2. Such tooling may only comprise one or two lanes of progressive cap-forming tools. This could be desired (for example) In the case of a lower output system, such as used to form caps of greater size for larger containers. Formed caps 10 exit from the cap forming apparatus via one or more exit chutes and are propelled by one or more air jets 26 directed into and along the chutes. In this embodiment the caps are oriented in an upright position (skirt rim down or public side up), toward receptors 32. Of course additional lanes of such progressive tooling can be used in a system designed for higher output A plurality of these receptors 32 are mounted onto the periphery of a step-wise rotating feeding piece or wheel 40 (FIG. 3-5), and caps are loaded into the receptors as the wheel indexes, driven by a stepping motor 45. Receptors 32 each have an outward facing inlet 33 which includes a generally U-shape cap carrier 35. The receptors are located in spaced locations about the periphery of wheel 40, and incoming caps from the cap system exit chutes (not shown) enter inlets 33, and each cap is supported by the underside of its rim 18, upon a ring-like bottom plate 36 through which seal pieces 20 of the exact desired dimension are thrust downwardly into the caps 10 (see FIGS. 4-6).

Sensor 27 is located along the path of the caps to the carrier receptors 32. If presence of a cap is not indicated at the sensor position, the seal piece forming and insertion operation can be halted as necessary. An optional feature (not illustrated) is the provision of a temporary cap storage container to one side of the incoming stream of caps, into which the caps may be diverted during 'down time' of the piece forming and inserting station.

Figure 6:
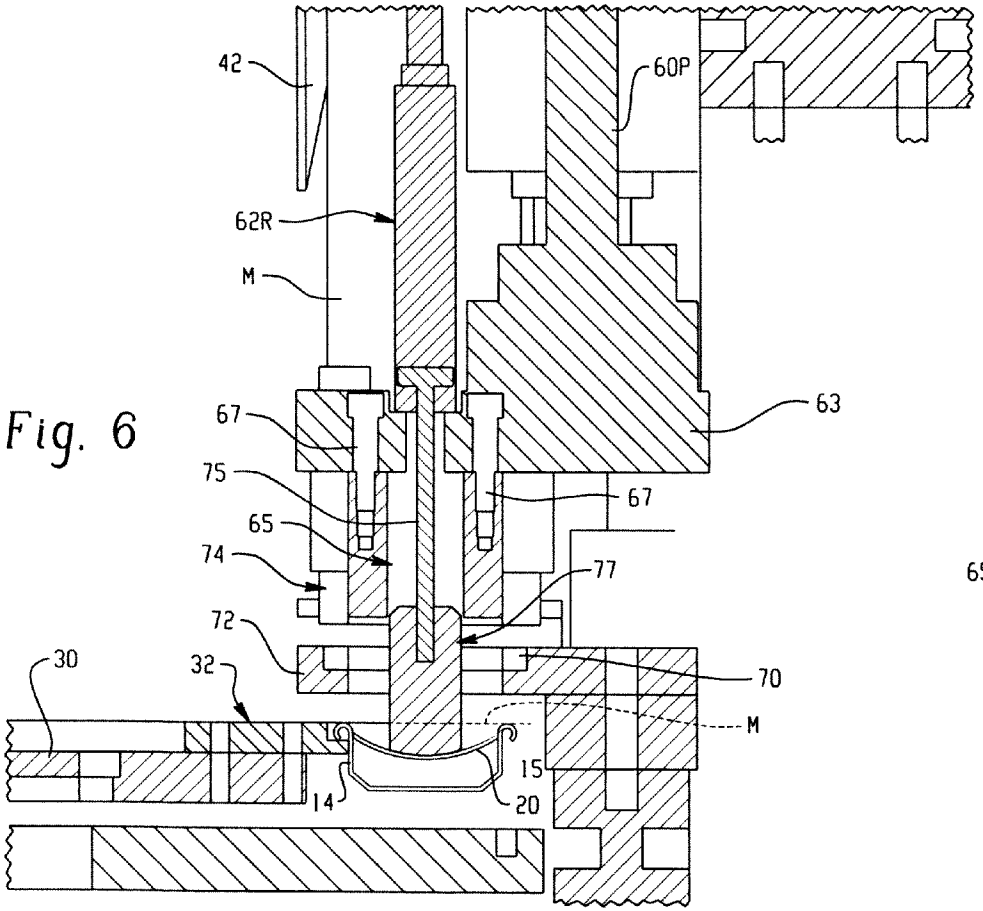
FIG. 6 is an enlarged cross-sectional view taken through the central part of FIG. 5, with the cutting die having formed a piece from the material and the resultant seal piece being pushed into the interior of a cap.

The seals 20 are then pushed past the cap lugs 12 into the cap skirt 14 (see FIG. 6). As previously explained, due to the fit of the seal 20 within cap skirt 14, the seal remains within the cap, close to or against the underside of top panel 13, and captured in the caps by the inwardly extending cap lugs 16. When the caps are fitted onto container necks, after filling of the containers, the outwardly rolled rim of the neck, defining the pour opening, will advance the seal into a tight sealing fit between the cap top panel underside and the pour opening rim, and preferably about a portion of the exterior of the pour opening rim.

Referring to FIGS. 3-5, a supply roll 40 of the seal material M is grasped between opposite sheaves 42 of a reel that includes an arbor shaft 43 located to one side of a forming and inserting station 35. This shaft in turn is connected to and driven by a stepping or servo motor 45 which rotates the supply roll. The end of the strip of material M is guided into a track 47 extending through station 35 to a strip feeding station 48. This station includes a pair of clamp devices 50, 52 that are actuated in a cycle to hold and/or advance the material M along track 47 past a vertically reciprocated punch 55 and its cooperating stationary cut edge 56.

Clamp device 50 is supported at a fixed distance from the punch axis, and clamp device 52 Is carried on a slide 58 that is reciprocated along track 47 toward and away from clamp device 50.

During actuation of the punch, clamp device 50 is engaged with the seal material strip M. When punch 55 is withdrawn upwardly, clamp device 52 is engaged and then clamp device 50 is released. A cylinder 60, attached to slide 58, moves the slide toward clamp device 50 to push the remains of the material M through clamp device 50 and draw a fresh area of material into position below punch 55. Then clamp device 50 is again engaged and clamp device 52 is released. This cycle provides a means to introduce the material M into the following seal punch and inserting mechanism. As this cycle continues to repeat, the stepping motor 45 will actuate to release a length of material into track 47.

FIGS. 5 and 6 illustrate the details of the seal forming and inserting station 35. A pair of co-operating cylinders 60 and 62 (preferably pneumatic) is supported extending vertically above track 47 at the location where a carrier receptor 32 presents a cap (inverted as shown) for insertion of a seal 20. Assuming that a fresh area of material M is present In track 47 above the cap, the piston 60P of cylinder 60 will first be caused to move an upper tool holder plate 63 downward, lowering the punch holder plate 64.

Figure 7:
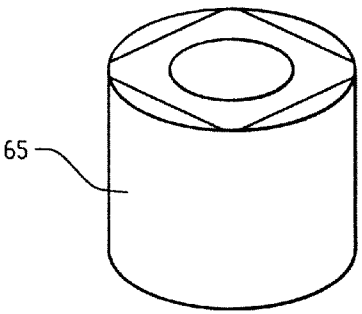
FIG. 7 is a perspective view of a typical punch tool.

A cylindrical punch 65 (FIGS. 6 & 7) is attached to the bottom of plate 64 by a pair of machine screws 67. Concentric with, and below, punch 65 a circular cut edge tool 70 is supported in a stationary lower tool holder 72 that is positioned as a section of track 47, and is sized to define the outer perimeter of a seal 20. A spring-loaded stripper ring 74 surrounds punch 65 and functions to engage the area of seal material M radially outward of the punch as it severs a seal (for example a disc), and to maintain the length of material aligned in track 47 as the punch 65 passes through the material.

The rod 62R of cylinder 62 operates parallel to piston 60P and includes a lower extension 75 passing through upper tool holder plate 63 into the center of punch 65. A knockout pin 77 is attached to rod extension 75 and remains within the punch until a seal is severed. The cylinder 62 is extended to cause the knockout 77 to push a severed seal into the cup below, past the cap lugs 12, as shown in FIG. 6.

The operating sequence continues with cylinders 60 & 62 retracted upward, and the sequence of clamp devices 50 and 52, and cylinder 60, will function to move a fresh area of material into the 'punch and insert' location.

It will be appreciated that either the foregoing embodiment of seal forming and inserting apparatus, or the more sophisticated embodiment hereinafter described, may if desired be used to form and insert seals independently of a cap forming apparatus.

Second Seal Forming & Inserting Embodiment

Figure 8:
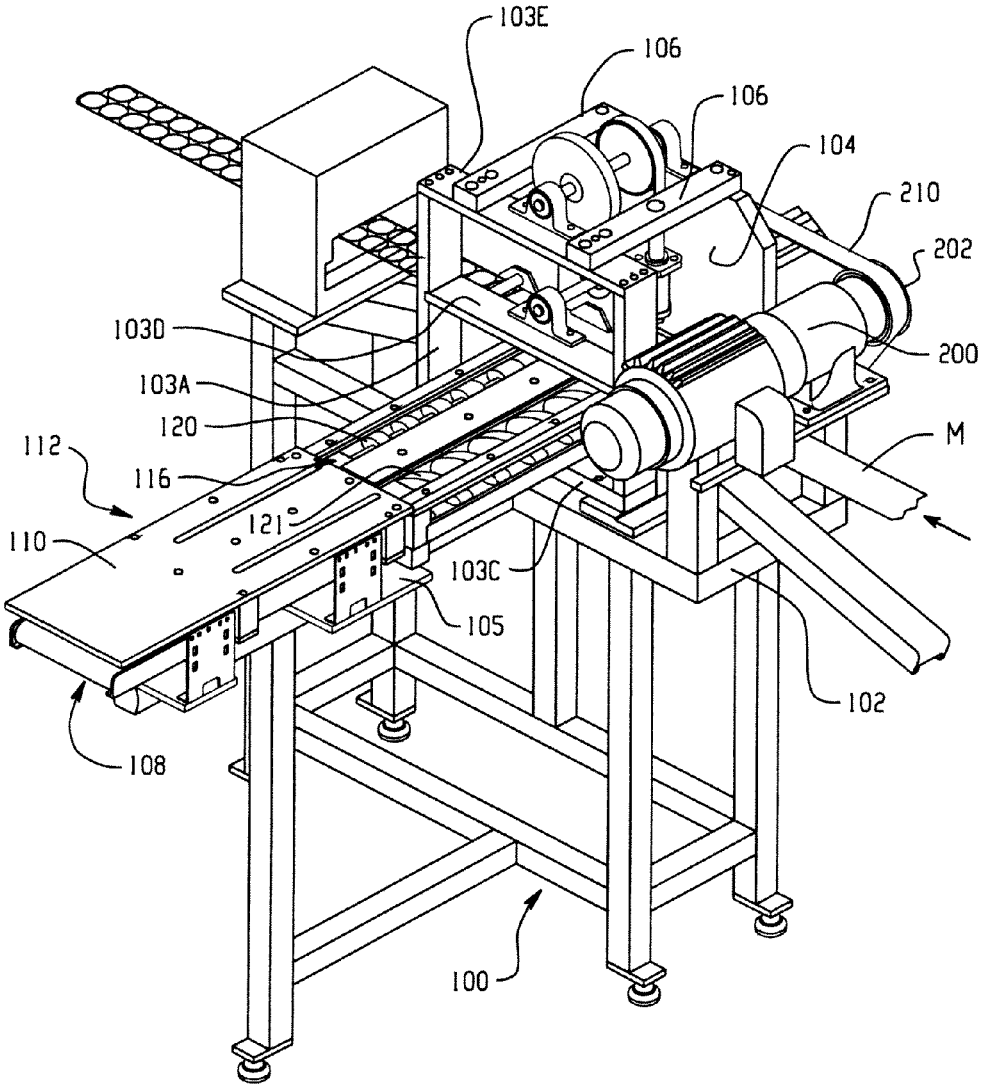
FIG. 8 is a perspective view, taken from the right front corner of a second form of seal forming and inserting apparatus.
Figure 9:
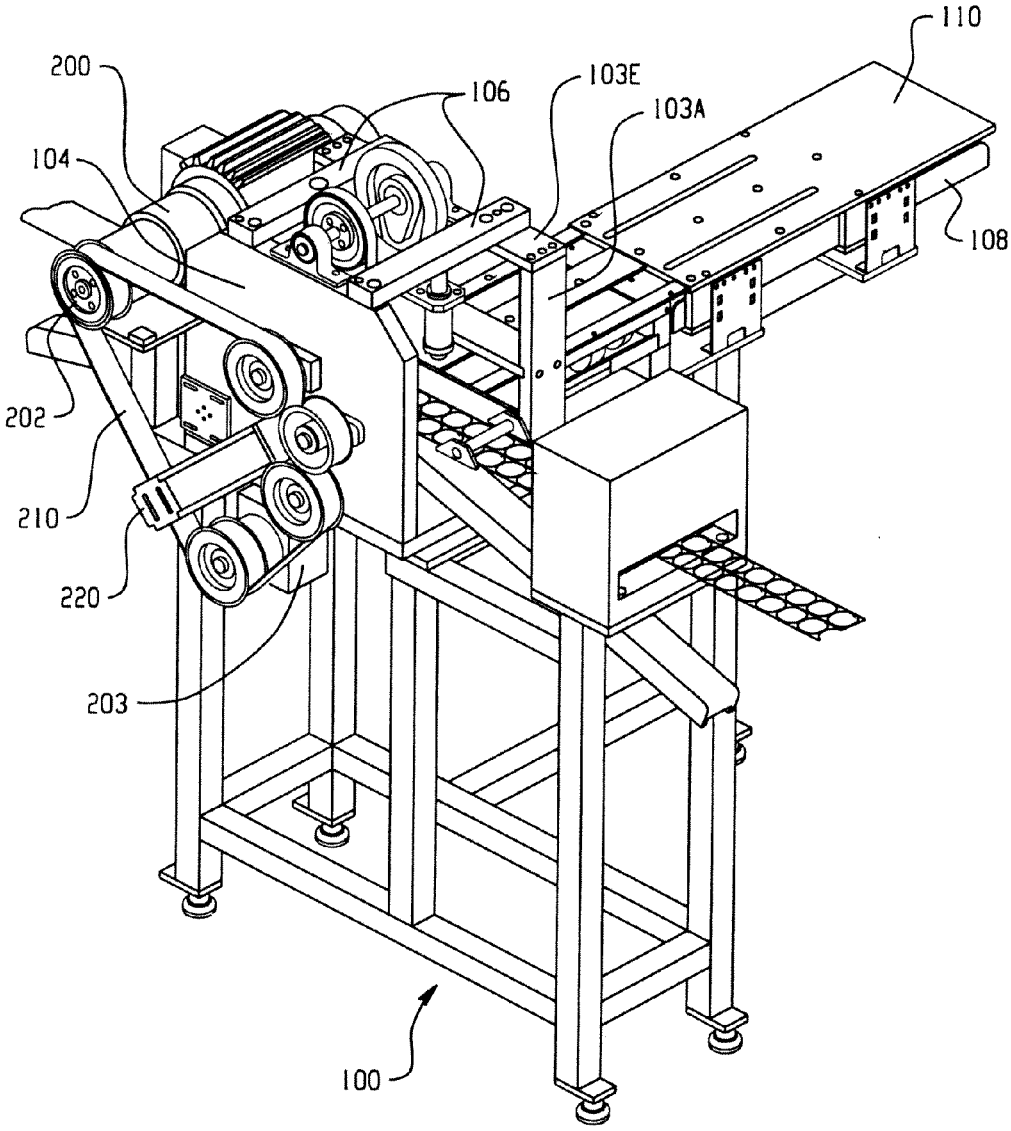
FIG. 9 is a perspective view, taken from the left rear corner, of the apparatus shown in FIG. 2.

The over-all arrangement of a second form of seal forming and inserting apparatus is illustrated in FIGS. 8 & 9. A fabricated stand 100 supports the apparatus and its central horizontal base plate 102. At the front of the base plate is a support structure comprising upright bars 103 A and 103 B, crossbars 103 C (at the bottom), 103 The (across the middle) and 103 E (secured atop the upright bars). A central uptight frame member 104 rests on, and extends upward from base plate 102. A pair of tie bars 106 extends from the upper edge of member 104 and the top crossbar 103 E.

An input or entrance table 105 extends forward of base plate 102 and supports a conveyor 108 which direct a supply of caps initially into the apparatus. A plate 110 is fitted atop this initial conveyor 108 and the caps, sliding on the exterior of their upper panels 13, are gathered into rows moving inward over plate 110. Caps 10 from a suitable source, such as shown in FIG. 2, are delivered onto table 105, the caps are oriented with the public side down, e.g. with the skirts 14 inverted and the cap opening upward.

The caps are generally aligned by suitable baffles or dividers (not shown) into multiple forward moving loosely defined rows on table 105. These rows of caps are advanced into a positive cap feed mechanism 112, using conventional means such as air tables, path-defining baffles, or (in the case of caps formed of a ferrous containing material) sets of magnets moving along a defined path over a non-ferrous table top.

Figure 10:
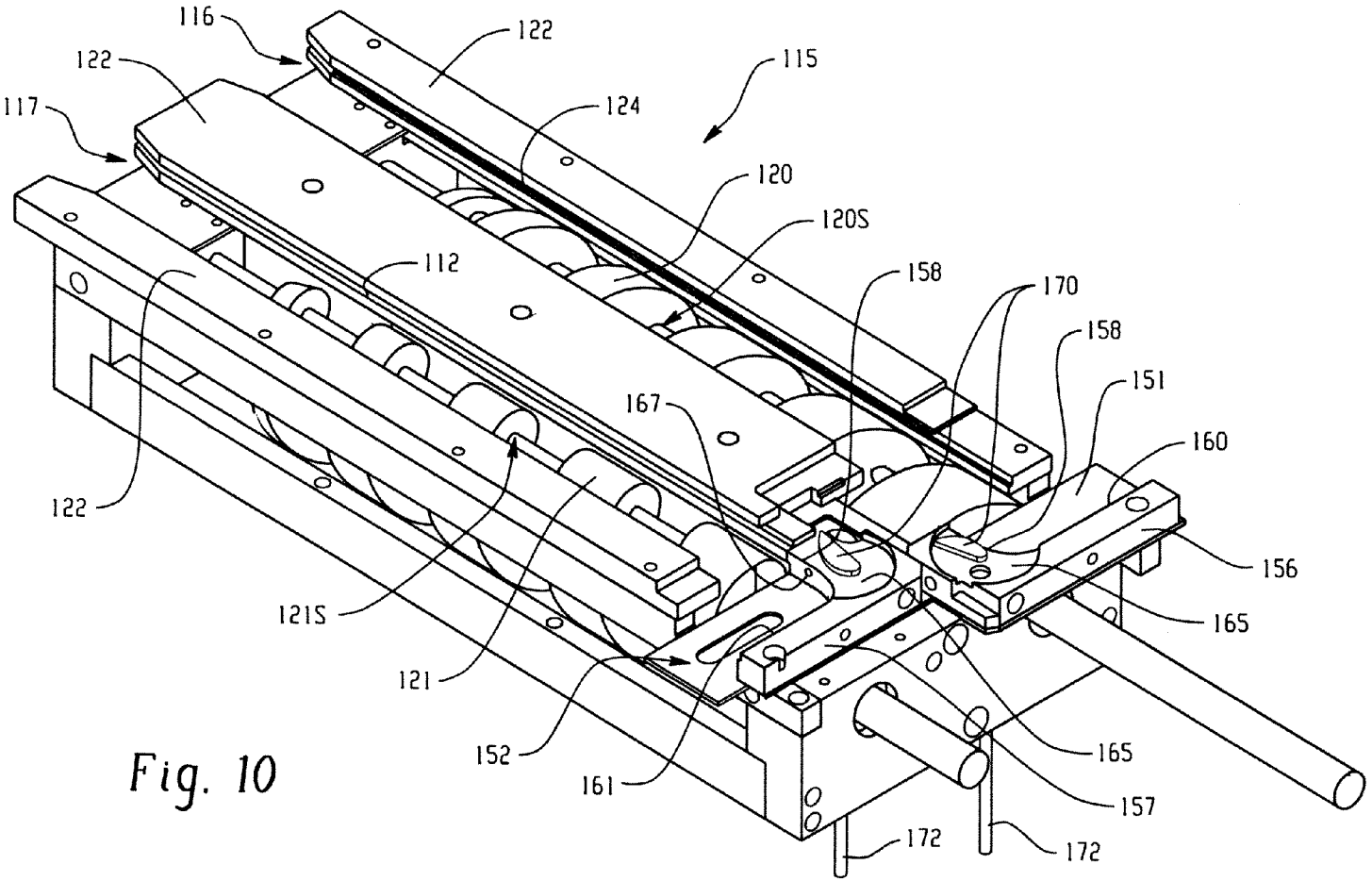
FIG. 10 is an enlarged perspective view of a dual feed screw mechanism shown in the center of FIG. 8.
Figure 11:
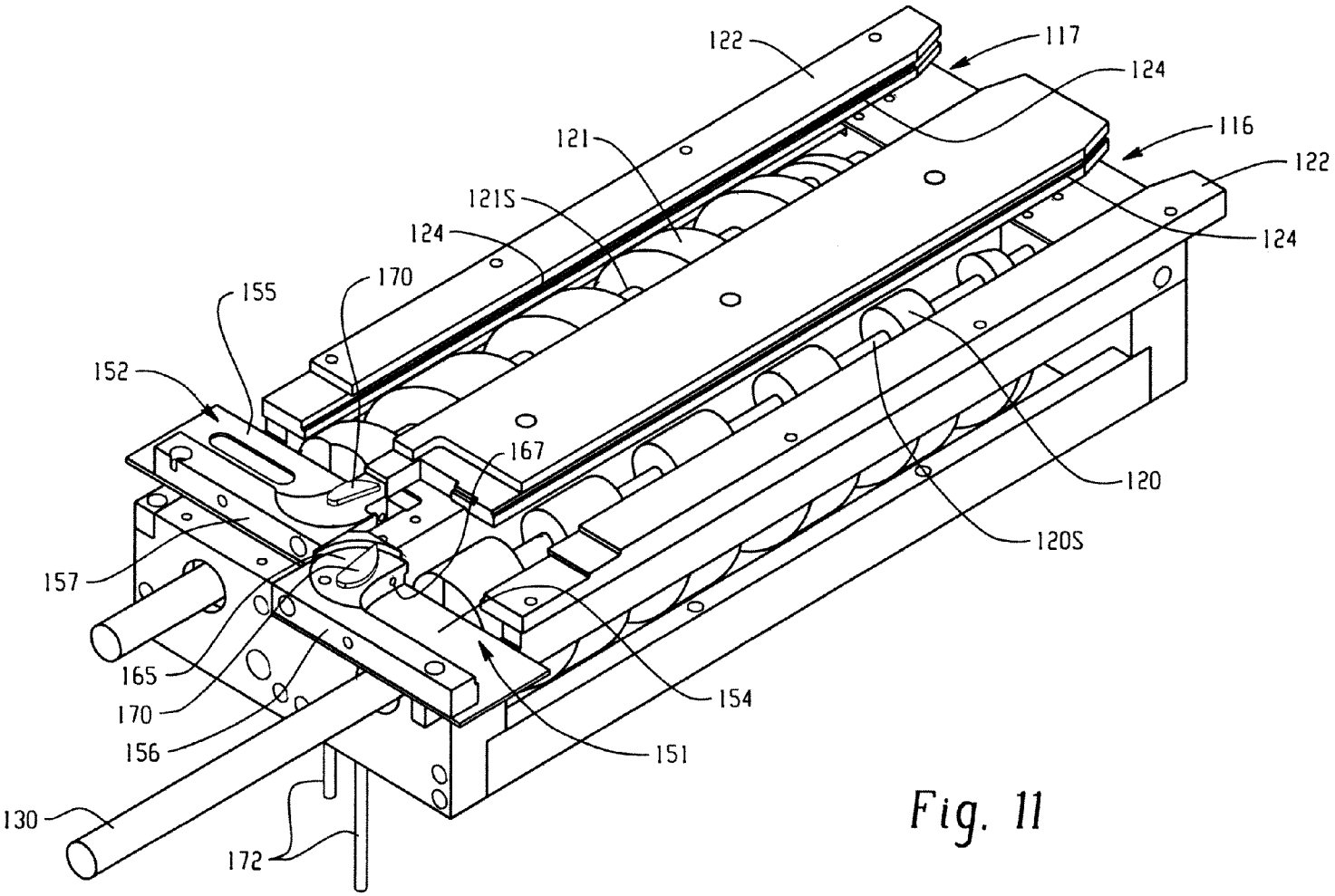
FIG. 11 is an enlarged perspective view of the discharge end of the mechanism shown in FIG. 10.

The positive-drive cap feed mechanism includes a feed table 115 provided with parallel slots 116 and 117 extending the length of table 115 (see FIGS. 10 and 11). Slots 115 and 116 cover multiple feed screws 120, 121 that extend beneath table 115 below slots 116, 117. Helical slots 120S and 121S are formed in the outer surface of each feed screw, and the forward moving rows of inverted caps move or descend into the helical slots and are carried forward in the feed mechanism 112. A major portion of the Inverted caps will project downward through the slots, leaving the outward (usually curled) extending edges of cap skirts 14 (and the cap lugs 16 therein) to slide along small grooves 124 formed along guide rails 122, opening above the surface of table 115 (see FIGS. 10, 11 & 13).

Figure 13:
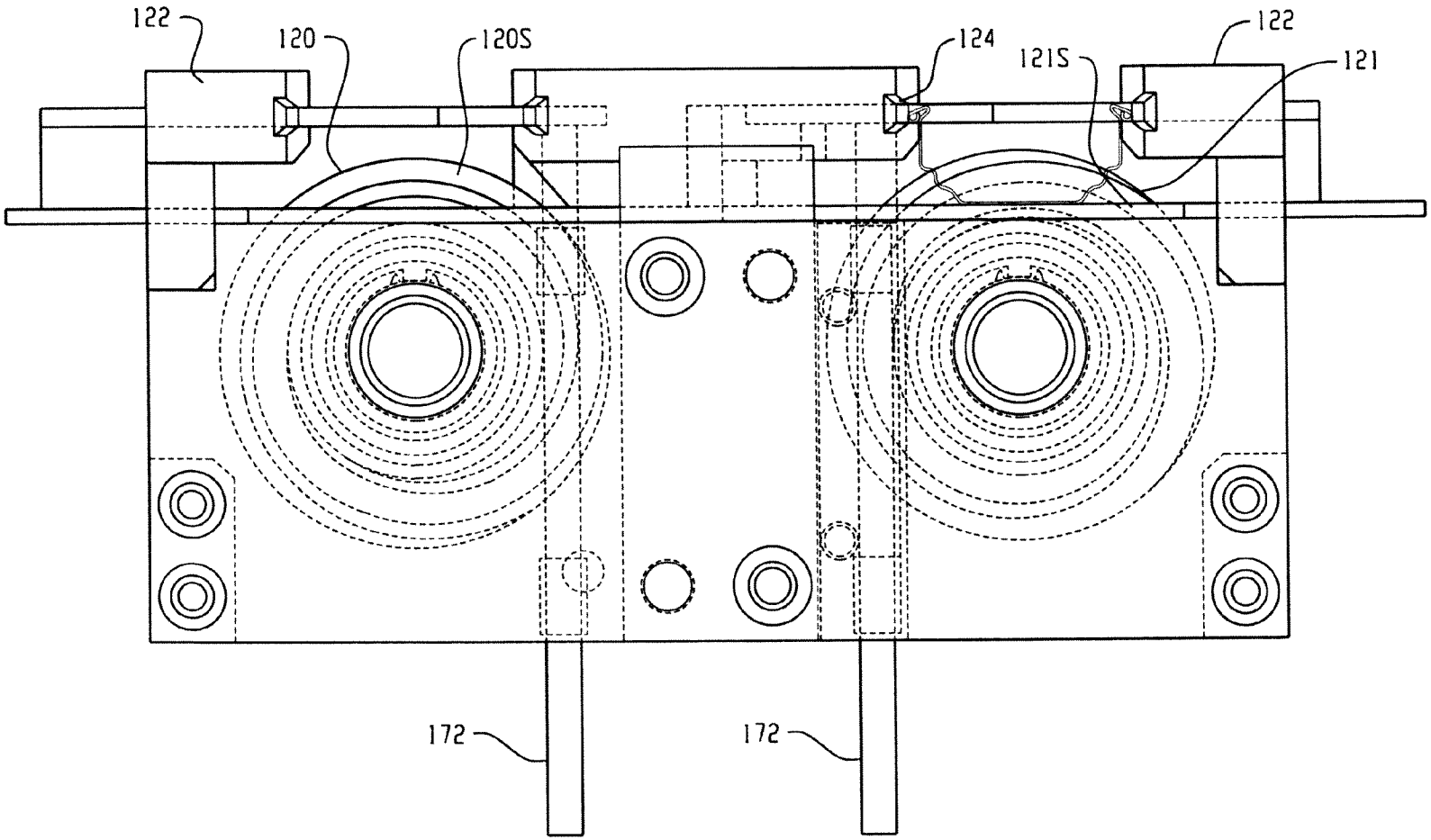
FIG. 13 is an enlarged end view of the feed screw mechanism, as seen from the left end of FIG. 12 and including the outline of a cap in the right side feed screw.

The thread-like slots 120S & 121S formed in feed screws 120,121 are deep enough to accept a substantial portion of the tops of the inverted caps (see FIG. 13). In addition, guide rails 122 (on opposite sides of slot 120) and 123 (on opposite sides of slot 121) are fitted to the table 115 above the side edges of those slots and maintain the proper interface between the cap skirts and the deed screws. When feed screws 120, 121 are appropriately rotated (preferably counter rotated), they carry the caps forward (from the front of the apparatus toward the center of the apparatus) along in-feed paths defined by the slots 116, 117 and toward the forward ends of the feed screws.

The thread 'lead' of feed screws 120 and 121 is increased (e.g. lengthened) progressively along at least the forward portions of their length, thus accelerating the forward motion of the caps while the feed screws are rotated at a common constant rotational speed during operation. Thus feed screw 120 is preferably rotated counter-clockwise by its longer drive shaft 130, and feed screw 121 rotated clockwise by Its shorter drive shaft 131 (as viewed from the front of the feed screw mechanism. In other words, in the embodiment illustrated, the feed screws are rotated at the same velocity but in opposite directions.

Figure 12:
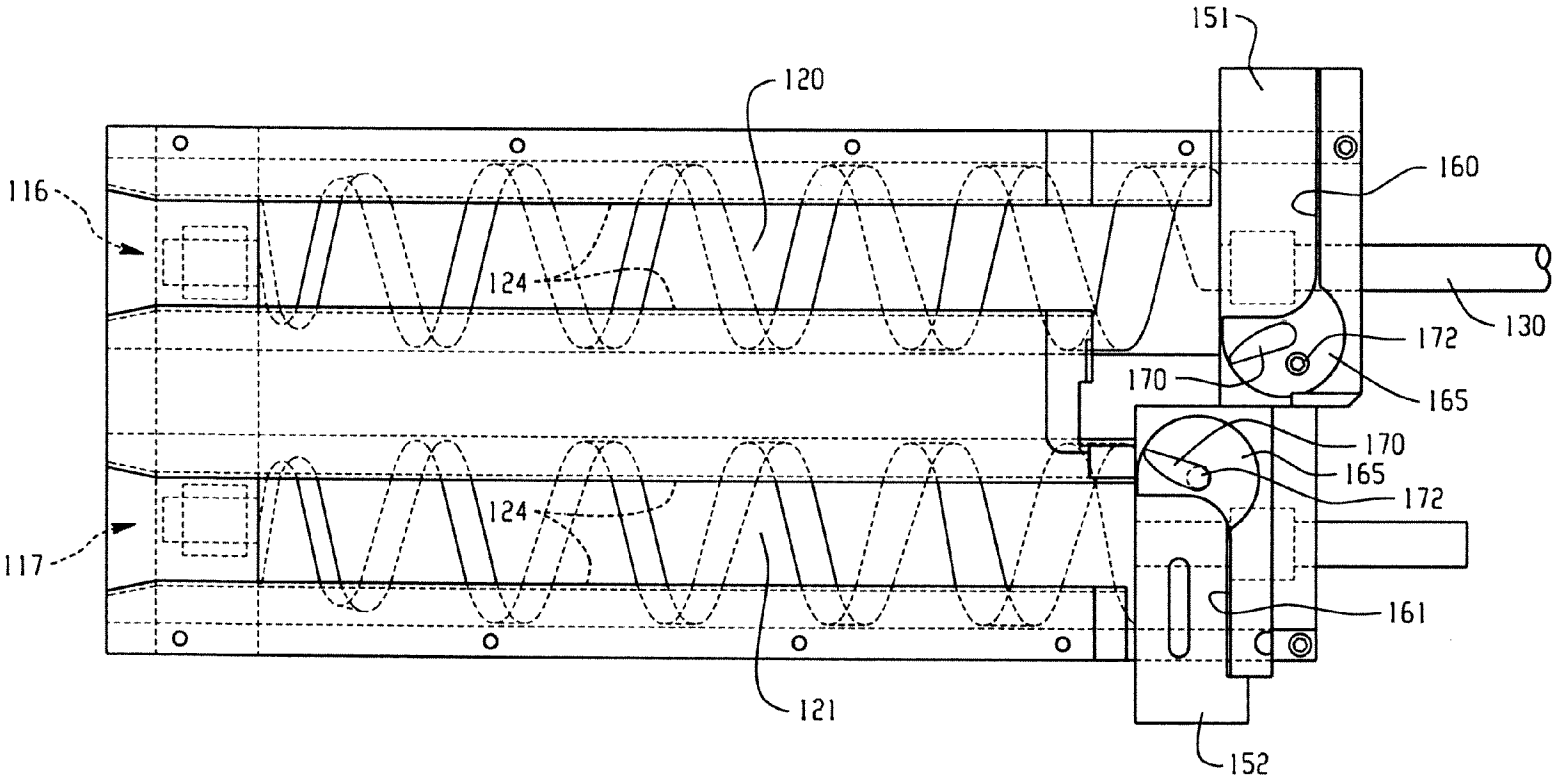
FIG. 12 is a top plan view of the dual fee screw mechanism.

FIGS. 10-12 illustrate the structures which form seal insert stations proximate to the discharge ends of the feed screws, extending across the forward ends of feed screws 120, 121. The feed screw mechanism includes insert stations 151, 152, located proximate to the discharge ends of each feed screw (see FIGS. 10, 11, 12, 15 & 16). The insert stations define the end (terminus) of the cap in-feeding operations and are located spaced apart in the front-back direction of the apparatus so as to locate the caps under different portions of the seal material strip which passes above them (see below). The stations are defined by laterally extending ledges or plates 154, 155 which receive and temporarily support each cap as the cap exits the adjacent feed screw. Contemporaneously, a seal piece 20 is formed from the material strip passing above, and the seal piece then is thrust downward into the cap.

The upper surfaces of plates 154, 155 are located at a level generally aligned with the bottom inner end of the helical slot in the adjacent feed screw. Thus, as a cap reaches the end of each lead screw, the cap is pushed onto the plate surface. The ends of the adjacent guide grooves 122 are cut back (see FIG. 10) to allow the upper rim of the cap to disengage and not interfere with this movement. Guide bars 156, 157 are fixed to the foremost edge of plates 154, 156 and provide lateral guide surfaces 160, 161 which will be engaged by the exterior of a cap skirt. Semi-cylindrical insert pieces 165 are fitted into similarly shaped cavities In the Inner ends of bars 156, 157 and these pieces present a curved abutment 158 that matches the guide surfaces 160, 161 of the guide bars to forward a cap outward over plates 154, 155. The insert pieces 165 include small ports 167 directed against a skirt of a passing cap, whereby bursts of compressed air can be supplied through such ports to assist such deflected motion of the caps, if an assist is found to be desirable.

Above insert pieces 165, close to the upper surfaces of the inserts, are thin rotating arms 170, fixed to small drive shafts 172 which enter the screw feed mechanism from below. Arms 170 are dimensioned to sweep across the upper surfaces of inserts and the curved abutment 158, and are driven in time with the feed screw drive, as later explained. The leading edges of arms 170 preferably are curved to push the caps outward and away as the arm passes by a cap skirt (see FIGS. 10-12)

Referring to FIGS. 9 & 8, which illustrate the rear and the front (respectively) of the apparatus, a suitable electric motor 200 is supported on the framework, at the upper right side of the apparatus (see also FIG. 8) and provides a single source of continuous rotary power for a major portion of the apparatus. A toothed pulley 201 is fastened to the motor shaft. At the lower end of the upright frame member 204, secured to the underside of base plate 102, is a 90° transfer gear box 203. A toothed pulley 205 is fastened to the gearbox input shaft, and at the top of gearbox 203 there is a toothed output pulley 206 which is connected to deliver rotary power to the shafts 172 that drive the arms 170 at the insert stations.

Figure 14:
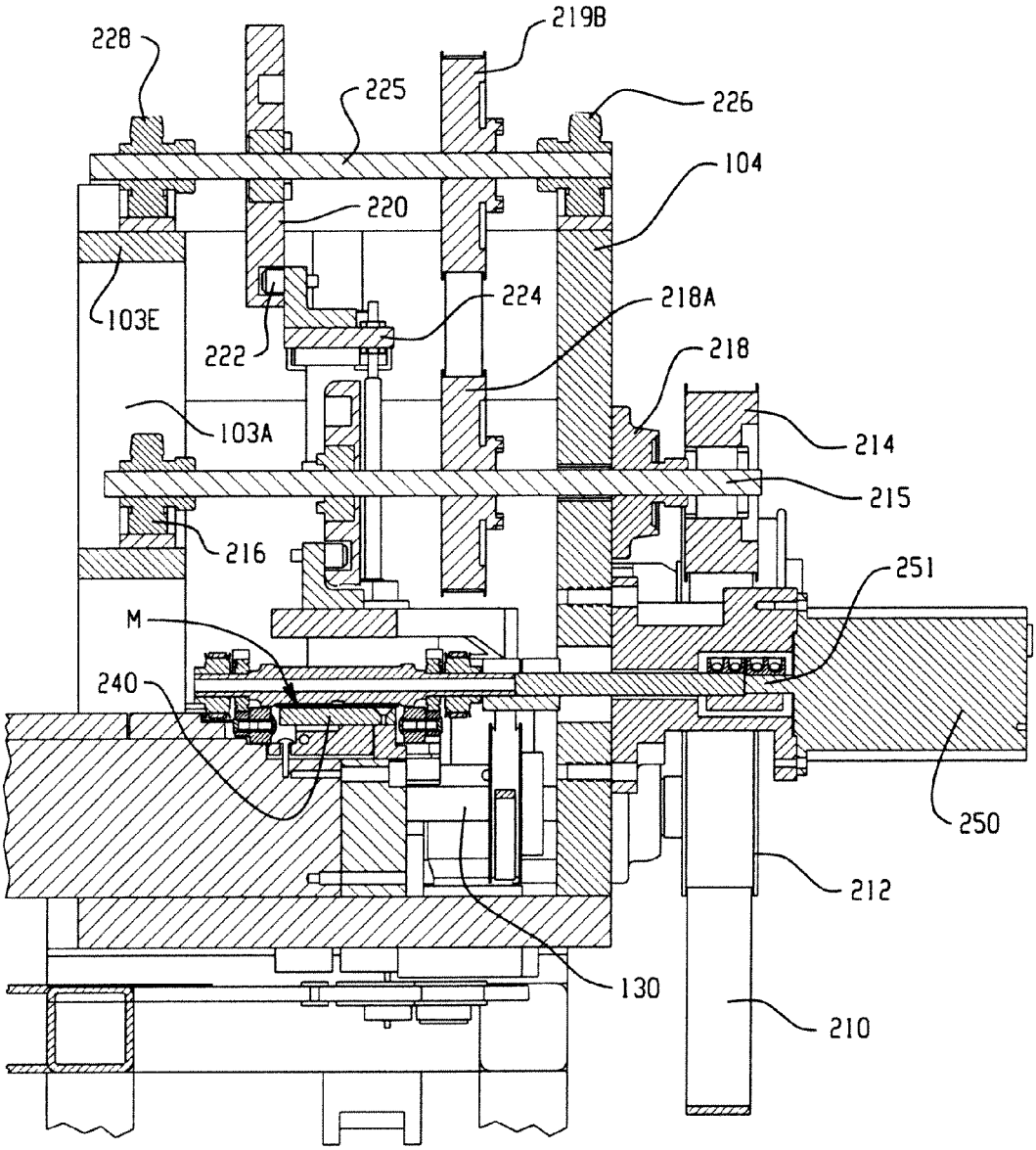
FIG. 14 is a vertical cross-sectional view through the power supply and transmitting mechanisms supported on both front and rear sides of the central upright frame member as seen in FIGS. 8 and 9.

The gearbox input pulley 205 is in a common plane with motor shaft pulley 202.and is driven by the motor through toothed belt 210. Near the lower edge of upright frame member 104 there is a further toothed pulley 212 that is coupled to the longer feed screw drive shaft 130. At the upper center of frame member 104 a further toothed pulley 214 is fixed to the end of a first (lower) transfer shaft 215 which is supported by bearing 216 at its rear end (FIGS. 9 & 14), and bearing 218 at its forward end (FIGS. 8 & 14). A second (upper) transfer shaft 225 is supported in bearings 226 (on top of plate 104) and 228 (on top of the top cross beam 103E. The transfer shafts 215 and 225 have toothed pulleys 219A and 219B secured to them and a toothed belt connects those pulleys such that the transfer shafts rotate in unison. Thus, power is supplied to the knock-out cam 220 and its cam roller/follower 222. The follower 220 is bolted to a crosshead bar 224 that is carried by bearing sleeves 225 so as to reciprocate (vertically) on stationary bearing posts suspended from tie bars 106 (see FIGS. 8, 15 & 16). Rods 227 are suspended from crosshead bar 224 and carry the knock-out heads 228 (later described) of the knock-out mechanisms (FIGS. 8, 9, 14, 15 & 16).

Figure 15:
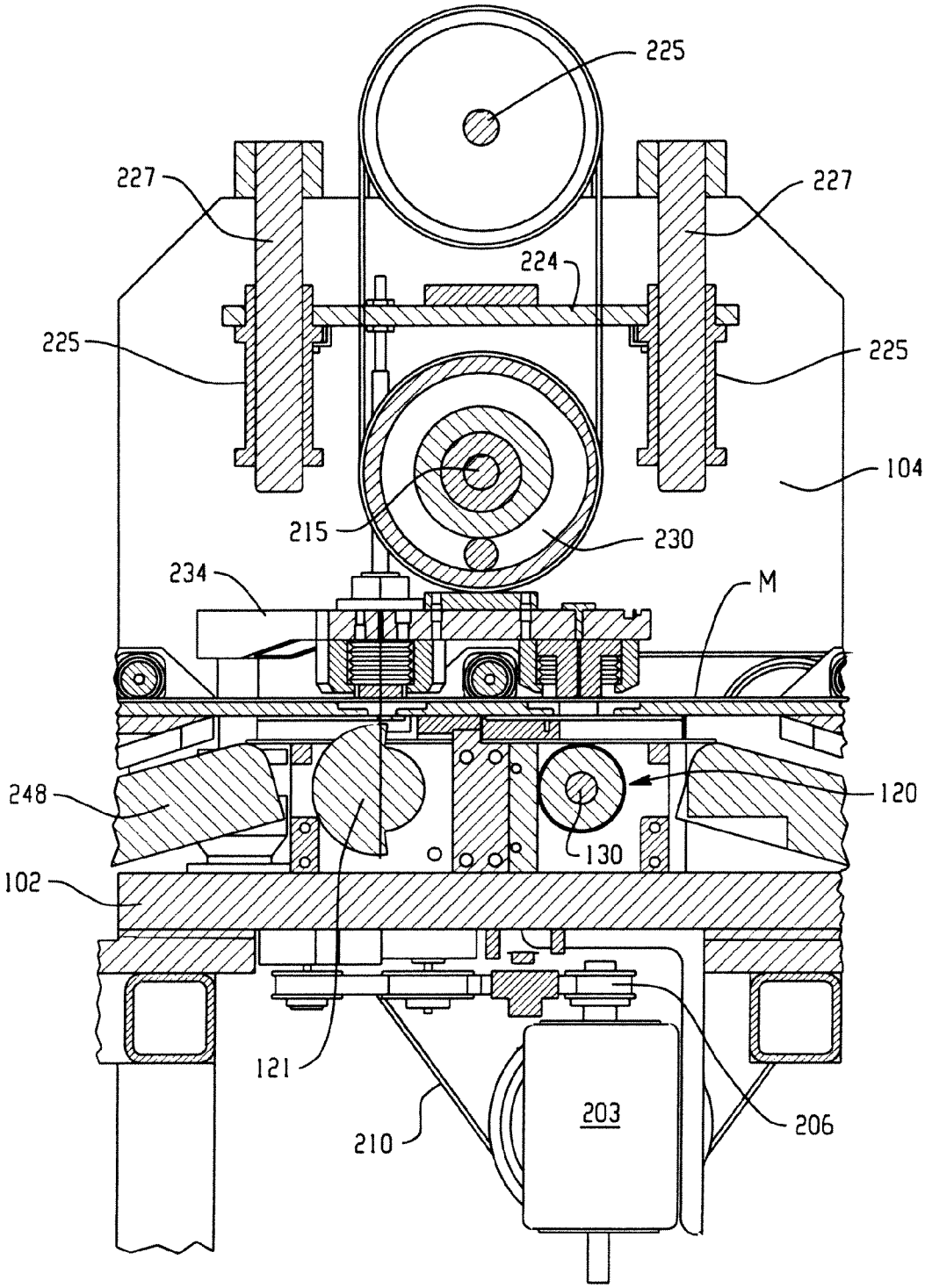
FIG. 15 (looking toward the front) and FIG. 16 (looking toward the rear) are vertical cross-section views taken through the center of FIG. 14, illustrating the cam and follower devices for controlling and driving the mechanisms that punch out the seal pieces and eject the pieces into caps supported below at insert stations proximate to the ends of the screw feed mechanisms.
Figure 16:
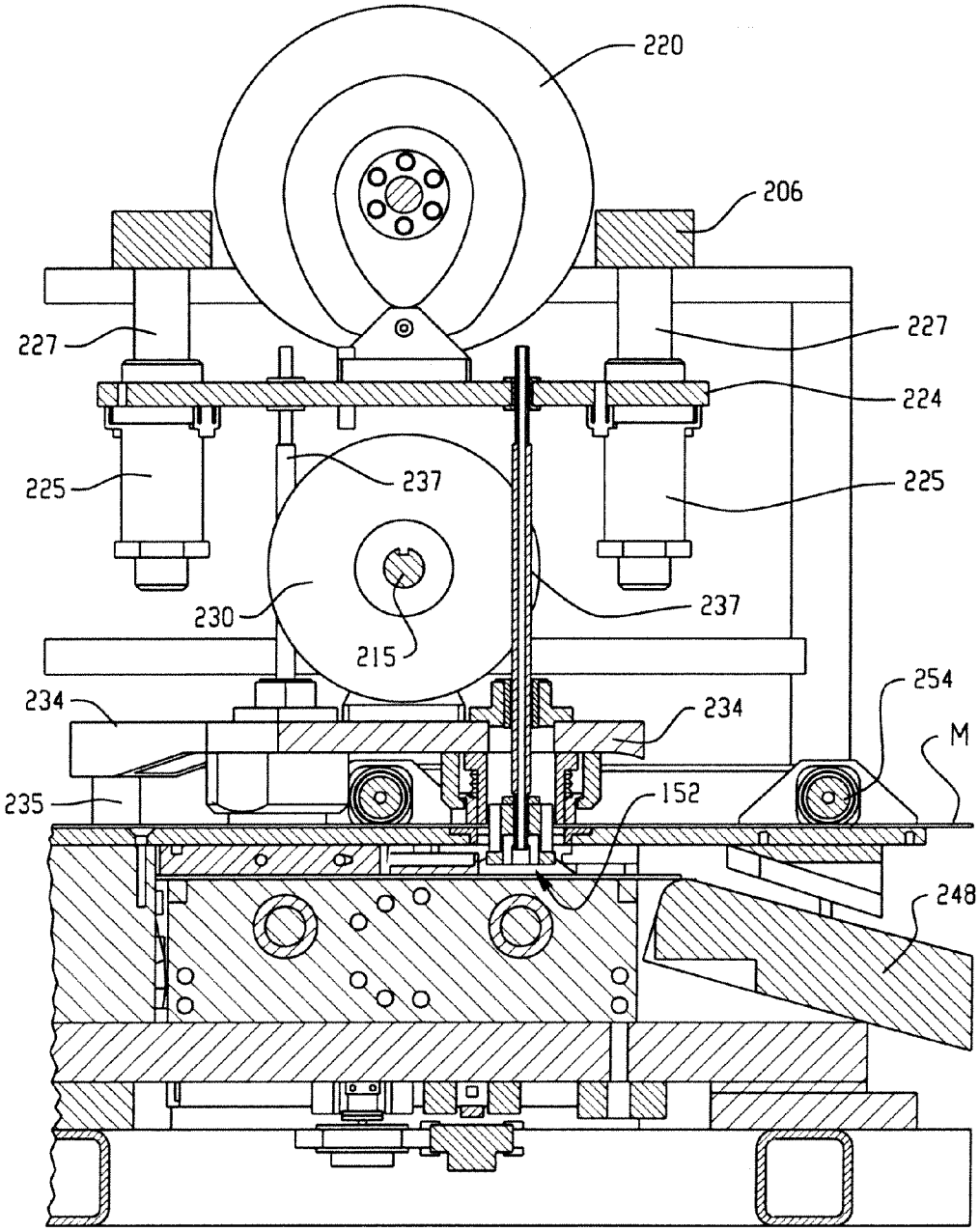
Figure 17:
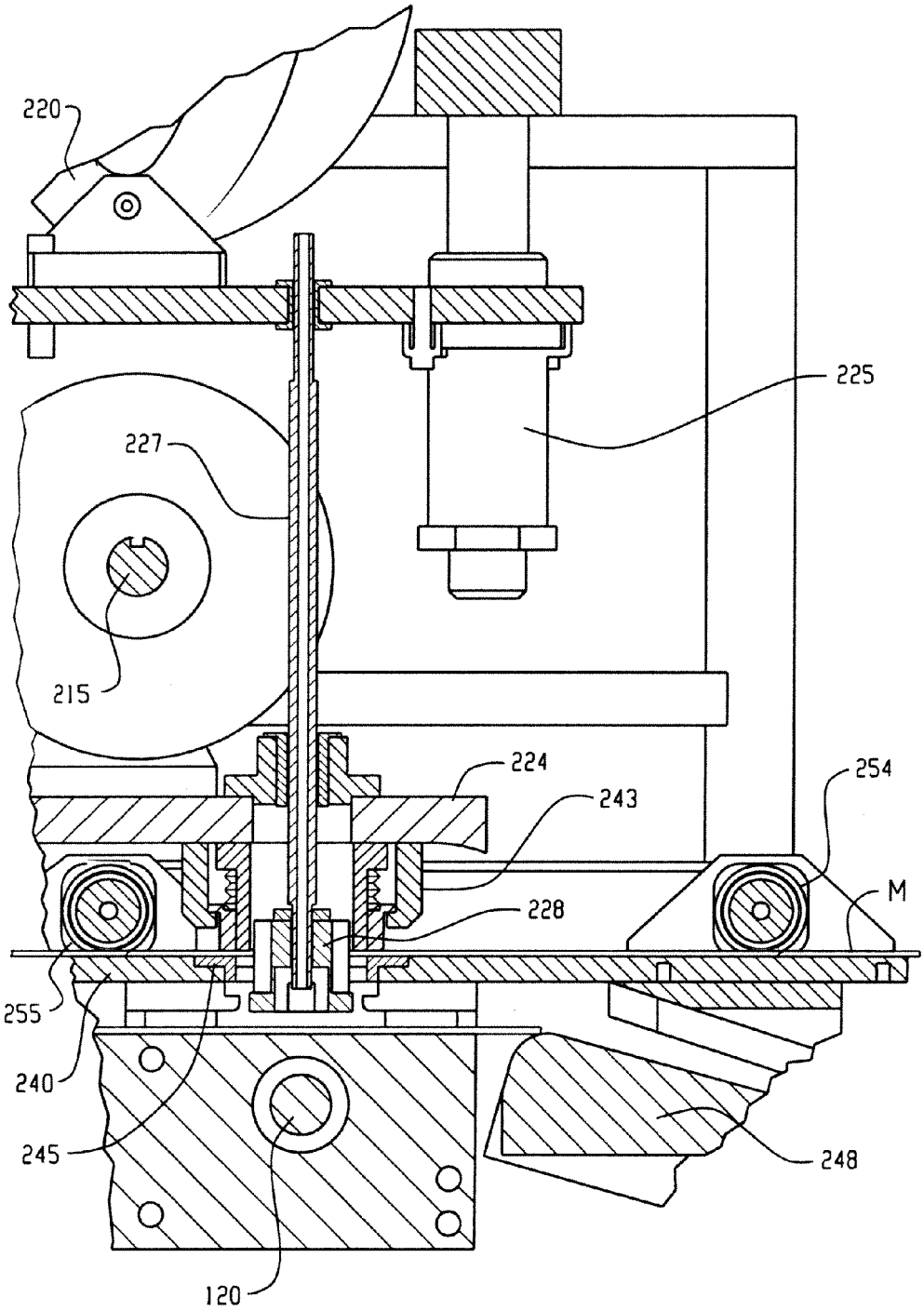
FIG. 17 is an enlarged central portion of FIG. 16, illustrating details of one of the two essentially identical seal piece punches and piece knockout/inserting mechanisms, aligned over a related inserting station, and also showing a portion of the seal material feeding mechanism.
Figure 18:
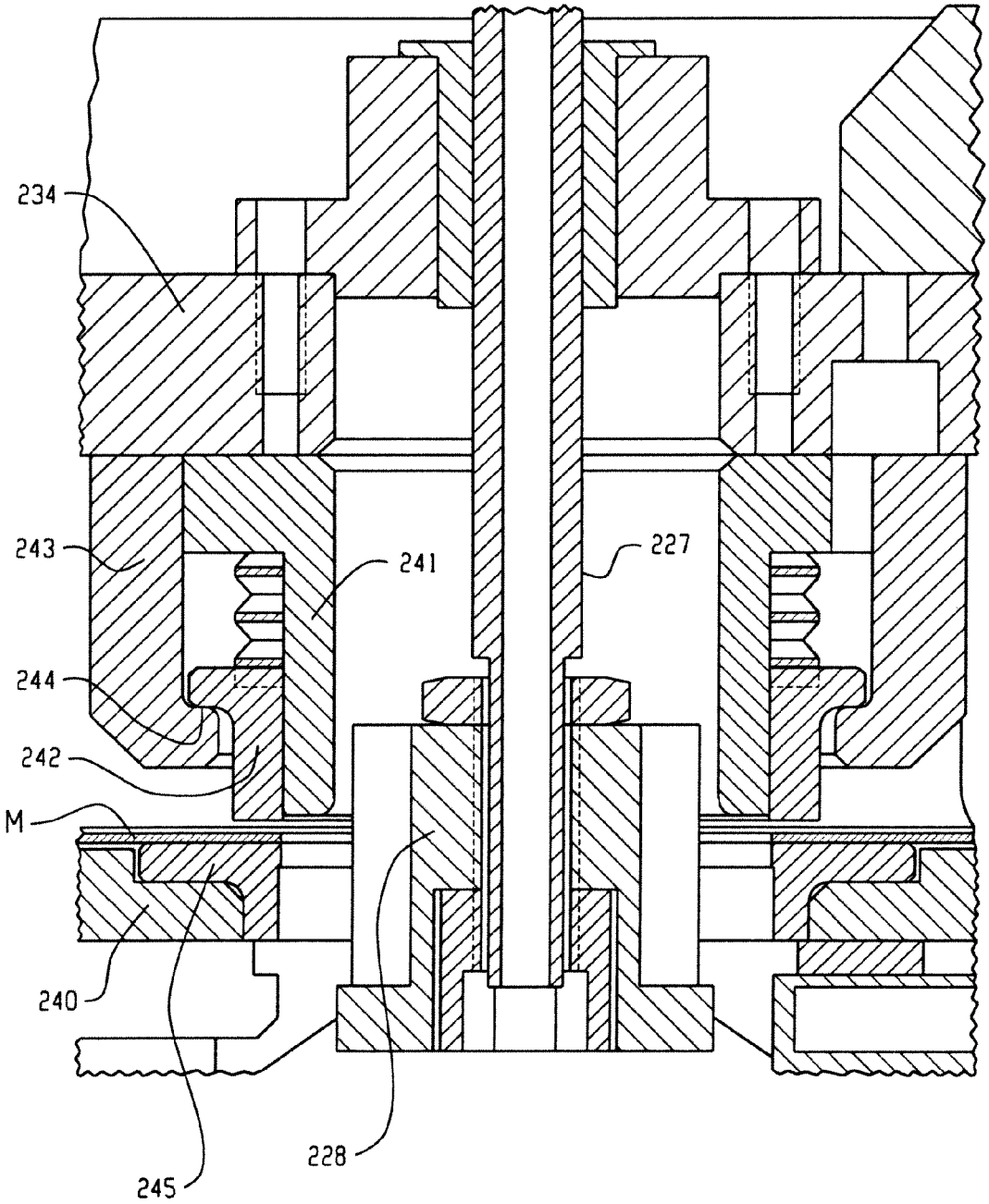
FIG. 18 is a further enlarged and isolated cross-sectional view of one of the punch and knock-out mechanisms which appear on a smaller scale in FIGS. 15 and 16.

The punch control cam 230 is fixed to and driven by lower transfer shaft 225, and its roller/follower 232 rides in that cam, and is fastened to the top of a lower crosshead 234 which is supported for limited vertical reciprocation by short vertical posts 235 which are mounted clear of the stock plate 240 which supports and guides the seal material strip M (see below). Two sets of punches are fastened to the lower surface of crosshead 234, as seen in FIGS. 15, 17 & 18. These each comprise an Inner punch ring 241 (circular for producing a disc seal if so desired), a stripper ring 242 surrounding the punch ring, an outer surrounding holder 243 including a ledge 244 which limits the motion of the stripper away from the punch, and a wave spring inside the holder, pressing against an outwardly extending ledge at the top of the stripper ring. The holder is fastened to the underside of crosshead 234 at a position where the punch rings 240 are concentric with a cut edge ring 245 supported in stock plate 240.

When cam 230 moves the roller/follower 232 downward (this travel is relatively short) punch ring 241 pierces the material M and moves the severed piece into the cut edge ring 245, while the stripper holds the material from which the seal piece is removed against the outer side of the cut edge. The knock-out head moves the seal piece further downward, into a cup which is waiting immediately below the stock plate 240 in an insert station. The knock-out head is quickly withdrawn upward by its cam drive, and the associated arm 170 sweeps across the insert station and moves the cap (now fitted with a seal) in to entrance of a suitable discharge conveyor 248 (shown schematically). There are separate such discharge conveyors for each of the insert stations.

Thus, the motor 200 and toothed belt 210 provide synchronous driving power to all of the aforementioned mechanisms, except for the stock feeding.

The seal material M is supplied in a continuous strip, as from a roll thereof, in the same manner as the seal material supply in the first embodiment (see FIGS. 3-5 and related description). The strip material enters below motor 200 and passes onto stock plate 240 which extends from right to left across the apparatus above the feed screw mechanism, specifically just above the seal inserting stations 151, 152. As shown in FIGS. 14, 15, 16 and 17 the stock plate has appropriate apertures which receive cut edge rings 245 which are aligned over the insert stations, and are therefore spaced apart lengthwise and transversely so that a pair of seal pieces may be cut from the material strip M while minimizing the amount of waste material in the resulting 'skeleton' strip (see FIGS. 8 and 9).

For that purpose, a servomotor 250 is also mounted on frame member 104, and its output shaft 251 is coupled (as by small toothed pulleys and belts, to the drive shafts of three spaced apart seal stock feed rollers 254, 255, and 256 (see FIGS. 14, 15, 16 & 17) which are utilized to advance the seal material M in increments sufficient to supply fresh stock into the punch and knock-out mechanisms for each cycle thereof.

Figure 19:
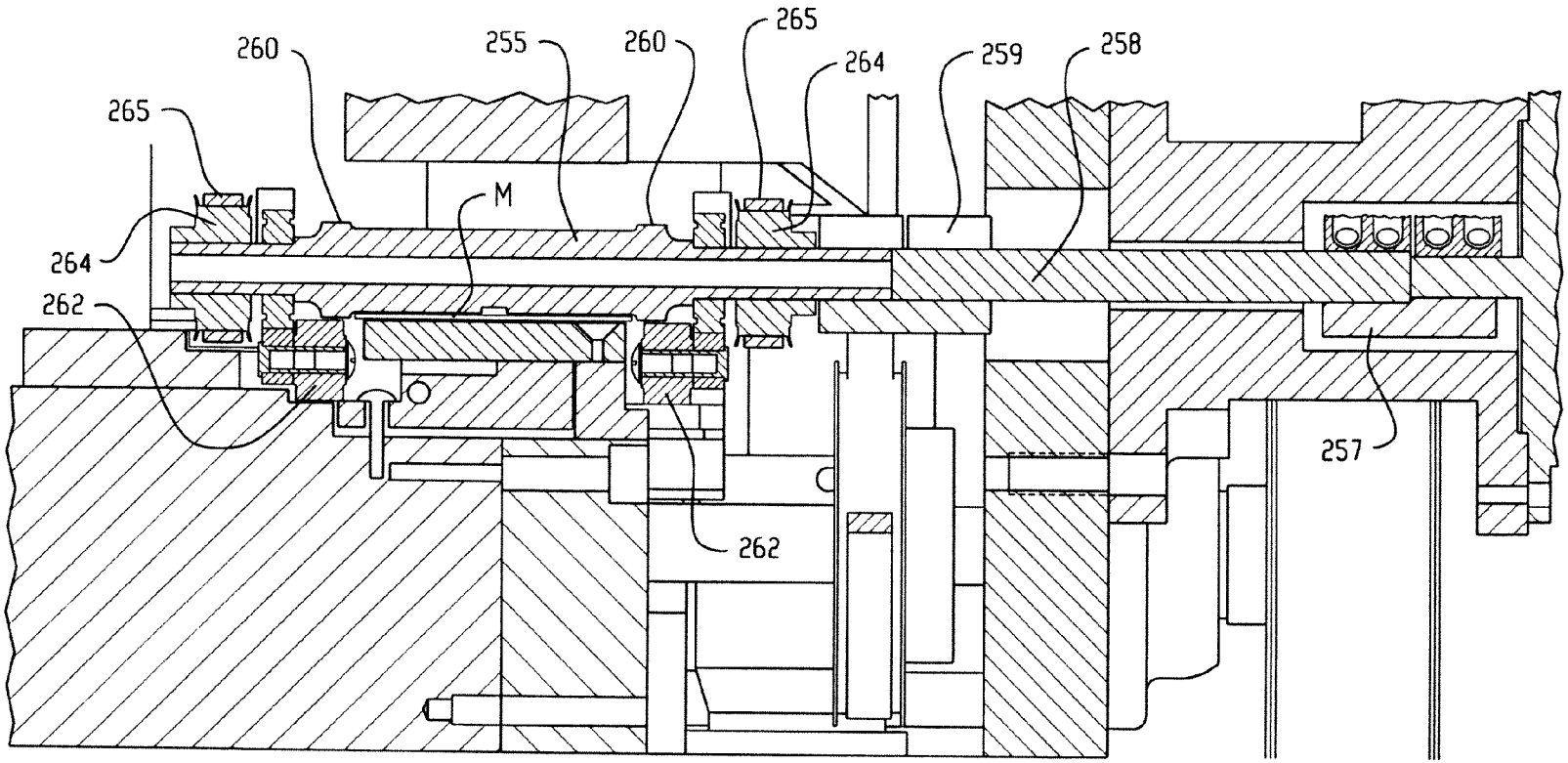
FIG. 19 is across-sectional view of the mechanism for incrementally feed the seal material across the punch, knock-out, and insert locations.

FIG. 19 illustrates an enlarged such roller 255, which is located between the two punch and seal insert locations, along with the small toothed pulleys and toothed belts which enable all of these feed rollers to move the material strip forward in unison, thereby maintaining desired tension in the strip during and between the incremental movements. The servomotor output shaft 221 is attached through a coupling 257 to the center roller 255 of the three spaced apart stock feed rollers. An extension shaft 258 is connected between coupling 257 and a second coupling 259, which is attached to the end of hollow feed roller 255.

There are 2 enlargements to 60 on the shaft, spaced apart a distance substantially equal to the opposite edges of seal material strip M. On the opposite side of the material strip, there is a pair of free rolling idler rollers 262 which will press against the strip edges. Enlargements 260 and idler rollers 262 are provided with gripping surfaces, as by knurling or etching, to assure a firm grip on the strip. Collars are preferably fixed to the roller body immediately outside the idler rollers 262, to enhance edge alignment as the strip is moved through the feed rollers. Outside the collars are toothed pulleys 264 which mesh with toothed belts 265.

The other roller assemblies are almost the same, except that roller 254 will have only one toothed roller aligned to interact with a belt connected to one side of the center roller 255, and roller 256 will have one toothed pulley to interact with a belt connected to the other side of the center roller. As a result, all three of the stock feed rollers will rotate in unison with the input from the servomotor.

The stepping motion of the servomotor will be less than a full revolution, in the order of 240° to 250°, and can be triggered to commence at some interval into the cycle of the device, for example by a sensor acting in response to an action such as the departure of a cap from the insert stations. Such sensor will then trigger a program in the servomotor's controller to initiate advance of the material strip such that fresh material is in place before the punch and knock-out action begins.

While the method(s) herein described, and the form(s) of apparatus for carrying this (these) method(s) into effect, constitute preferred embodiments of this invention, it is to be understood that the invention is not limited to this (these)

precise method(s) and form(s) of apparatus, and that changes may be made in either without departing from the scope of the invention.

What is claimed is:

1. A method of including an internal seal piece in a metal container cap for sealing receipt against an outer surface of a pour opening formed in a neck of a container, the method comprising the steps of:

providing an integral cup-like metal member defining a metal cap having a top panel, a skirt depending in substantially perpendicular relation from the top panel, an angled surface interposed between the top panel and the skirt, and a plurality of cap lugs formed in a rim and extending partially inward from the rim, the skirt being dimensioned to surround the neck on the container, the neck having lugs extending outwardly to engage the cap lugs, and the neck also having a curled upper end defining the pour opening, the curled upper end being aligned with the cap and spaced radially inward of the skirt so as to advance toward the cap top panel as the cap is applied to the neck such that the angled surface is positioned for engagement with the neck outwardly of the container pour opening, gathering a quantity of the caps and arranging the caps onto a surface with the rims facing a predetermined plane;

moving the caps into a lane including at least one row;

advancing the caps seriatim in the row to an inserting station closely spaced from said predetermined plane;

providing a supply strip of flexible seal material;

directing the strip into proximity to the inserting station and precisely cutting a seal piece from the strip, the perimeter of such seal piece being greater than the internal diameter of the cap lugs and approximately equal to the interior of the cap skirt, such that a friction fit may exist between the seal piece perimeter and the inner diameter of the skirt;

inserting the seal piece into the cap past the cap lugs and into the vicinity of the cap top panel; and incorporating the seal piece in the cap so that the angled surface of the cap positions the seal piece against the outer surface of the container exterior of the pour opening when the cap lugs engage the container neck lugs and seal the cap on the container and the seal piece conforms to an interior of the cap.

2. The method of claim 1, wherein at least two rows of caps and at least two inserting stations proximate to the rows; and simultaneously cutting at least two seal pieces from the strip and inserting the two seal pieces into a cap from each row.

3. The method of claim 2, wherein the advancement of the caps includes providing an accelerating motion as the caps are moved toward the inserting stations.

4. The method of claim 3, wherein the caps are carried on a conveyor screw mechanism and the acceleration is provided by an increase of the lead pitch of the screw mechanism.

5. The method of claim 4, including providing the screw mechanism with incorporated inserting stations at the output end thereof, and directing the caps from the conveyor screw mechanism directly into the respective inserting stations.

6. The method of claim 5 including punching a seal piece from the supply strip and immediately advancing the seal piece into a cap at the inserting station.

7. The method of claim 1 wherein the seal piece cutting step includes sizing the cut seal piece so that the seal extends about an exterior portion of the curled upper end that defines the pour opening.

* * * * *

UNITED STATES PATENT AND TRADEMARK OFFICE

CERTIFICATE OF CORRECTION

PATENT NO. : 8,677,594 B2
APPLICATION NO. : 11/794588
DATED : March 25, 2014
INVENTOR(S) : Steven T. Cook It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1414 days.

Signed and Sealed this
Twenty-ninth Day of September, 2015

Michelle K. Lee

Michelle K. Lee
*Director of the United States Patent and Trademark Office*